US010088282B2

(12) United States Patent
Laporte et al.

(10) Patent No.: US 10,088,282 B2
(45) Date of Patent: Oct. 2, 2018

(54) MANUAL LAUNCHER WITH REMOTELY SITUATED CONTROL

(71) Applicant: LAPORTE HOLDING, Biot (FR)

(72) Inventors: Jean-Michel Laporte, Biot (FR); Jean-Marc Fouques, Claviers (FR)

(73) Assignee: LAPORTE HOLDING, Biot (FR)

( * ) Notice: Subject to any disclaimer, the term of this patent is extended or adjusted under 35 U.S.C. 154(b) by 0 days.

(21) Appl. No.: 15/537,623

(22) PCT Filed: Dec. 14, 2015

(86) PCT No.: PCT/EP2015/079589
§ 371 (c)(1),
(2) Date: Jun. 19, 2017

(87) PCT Pub. No.: WO2016/096723
PCT Pub. Date: Jun. 23, 2016

(65) Prior Publication Data

US 2018/0017364 A1 Jan. 18, 2018

(30) Foreign Application Priority Data

Dec. 19, 2014 (FR) ..... 14 62949

(51) Int. Cl.

| | |
|---|---|
| ***F41J 9/18*** | (2006.01) |
| ***F41J 9/22*** | (2006.01) |
| ***F41B 3/03*** | (2006.01) |

(52) U.S. Cl.
CPC ..... *F41J 9/22* (2013.01); *F41B 3/03* (2013.01); *F41J 9/18* (2013.01)

(58) Field of Classification Search
CPC ..... F41J 3/03; F41J 3/04; F41J 9/18
See application file for complete search history.

(56) References Cited

U.S. PATENT DOCUMENTS

| | | | | | |
|---|---|---|---|---|---|
| 1,206,416 | A * | 11/1916 | Cosby | F41J 9/20 | 124/36 |
| 2,331,368 | A * | 10/1943 | Baldwin | F41J 9/20 | 124/9 |
| 4,282,848 | A * | 8/1981 | Kulesza | A63B 69/408 | 124/16 |
| 5,121,735 | A * | 6/1992 | Hancock | A63B 69/408 | 124/41.1 |
| 8,336,530 | B2 * | 12/2012 | Wang | A63B 69/408 | 124/16 |

* cited by examiner

*Primary Examiner* — John Ricci
(74) *Attorney, Agent, or Firm* — Hauptman Ham, LLP

(57) ABSTRACT

The invention has for object a mechanical target-launching machine comprising a loading system 1 and an actuator 3 which are disjointed from one another. The actuator 3 and the loading system 1 are connected to one another by a power transmission device 2. Said power transmission device 2 is a flexible element and preferably an arming cable 21. An energy accumulator 6 allows energy to be stored so that it can be released abruptly and allow the launching of a target 29.

12 Claims, 8 Drawing Sheets

MANUAL LAUNCHER WITH REMOTELY SITUATED CONTROL

FIELD OF THE INVENTION

This invention relates in particular to a machine allowing for the launching of targets, as well as a method allowing for the arming and/or the triggering of said machine.

A preferred application relates to the sports industry, and in particular archery.

In this framework the invention can be used to project polymer foam targets. This application is not limiting.

TECHNOLOGICAL BACKGROUND

In this latter field, there are many automatic target-launching machines for archery. These machines operate using electrical energy, as such, the arming thereof and the triggering thereof are not entirely mechanical. These machines applied to archery are not perfectly suitable for the users. The latter prefer the use of entirely mechanical machines, which is more in line with the philosophy of this sport. The first problem to be resolved was therefore to constitute a machine that operates without any forces other than mechanical forces.

This problem has already been resolved. It is moreover through this solution that target-launching machines developed. The main problem raised by this type of machine is the need for the presence of an assistant for the supplying, arming and triggering of the launcher. As such, a single person cannot operate the machine and shoot the target.

A similar problem is found in machines that make it possible to launch baseballs. A first solution was found with U.S. Pat. No. 8,336,530. This patent discloses a machine that can be armed thanks to a pedal fixed directly to the frame of the machine. The triggering of the machine is carried out remotely using a pedal connected to the machine by a cable. Finally, a store of balls allows for the automatic supply of the machine (supply limited to the number of balls in the store). With this solution a baseball batter can arm the machine alone, then position himself in order to receive the ball, and finally remotely trigger the launching of the ball.

This patent however remains not very practical in the framework of an individual use of the machine.

There is a need for a machine with more practical use.

The invention makes it possible to overcome all or a portion of the disadvantages of the current techniques.

SUMMARY OF THE INVENTION

An aspect of the invention in particular relates to a target-launching machine comprising:

an element for projecting a target mounted mobile on a frame, an arming device of the projection element, said device comprising:

a first portion not supported by the frame and including an actuator, with the actuator being configured to receive an input energy produced by a movement of a user, a system for charging an accumulator configured to store input energy in the accumulator, a second portion including an output member mounted on the frame, and an output member being configured to drive the projection element, said projection element being mobile via the output member through the release of a quantity of energy accumulated in the energy accumulator, a connection between the first portion and the second portion by a power transmission device;

Advantageously, the loading system is configured to accumulate energy required for a launcher in the actuator thanks to a plurality of arming cycles.

Advantageously the invention describes an arming device that comprises a first portion not supported by the frame and including the actuator, and a second portion including the output member mounted on the frame, the first portion and the second portion being connected by a power transmission device.

This specific architecture of the target-launching machine makes it possible to remotely perform an arming and a triggering which may be mechanical of the machine so that a user can use it alone.

This invention also relates to a target-launching machine wherein the actuator and said loading system are disjointed from one another and are connected by a power transmission device.

This arrangement makes it possible to arm and to trigger the launcher remotely thanks to the power transmission device that connects, in a non-limiting example, said loading system and the actuator. Although in prior art, the actuator is directly connected on the loading system, the invention combats this prejudice and offsets the actuator by providing a separating power transmission device between two portions of the arming device, with the actuator made free to be displaced in relation to the frame of the machine. Preferably, the actuator is as such not mounted on a frame with the rest of the machine. It can be placed, for example, in the vicinity of an area of presence of one or several archers.

Advantageously non limitative, the invention also describes a power transmission device that comprises at least one flexible element between the actuator and the loading system.

This solution allows for the connection between the actuator and the frame. Therefore a force transmitted by the user can reach the target-launching machine.

This invention also relates to a method for using a target-launching machine, with the method comprising the following arming steps:

a. activating of an actuator by the input energy coming from a user;

b. transmitting of the input energy to a system for charging the accumulator with energy;

Advantageously the energy required to proceed with launching at least one target is accumulated by a plurality of arming cycles, with each arming cycle comprising a movement of the actuator from a rest position generated by a force from the user that procures input energy and a movement of the actuator to the rest position during a releasing of the force from the user.

In an alternative embodiment, this invention relates to a method for using the target-launching machine that comprises an element for projecting a target, said projection element being mobile through the release of a quantity of energy accumulated in an energy accumulator, Advantageously with the method comprising the following arming steps:

activating an actuator by the input energy coming from a movement of a user;

transmitting the input energy to a system for charging the accumulator with energy;

Advantageously the energy required to proceed with the launching of at least one target is accumulated by a plurality of arming cycles.

As such it is the force transmitted by the user to the actuator that allows for a remote mechanical loading of the machine.

By separating the actuator from the rest of the machine, the invention goes against a prejudice in that the charging with energy of the machine, without electricity, is not normally considered as able to be accomplished remotely.

BRIEF INTRODUCTION OF THE FIGURES

Other characteristics, purposes and advantages of this invention shall appear when reading the following detailed description, and with regards to the annexed drawings provided and non-limiting examples and wherein.

DETAILED DESCRIPTION

Figure 1:
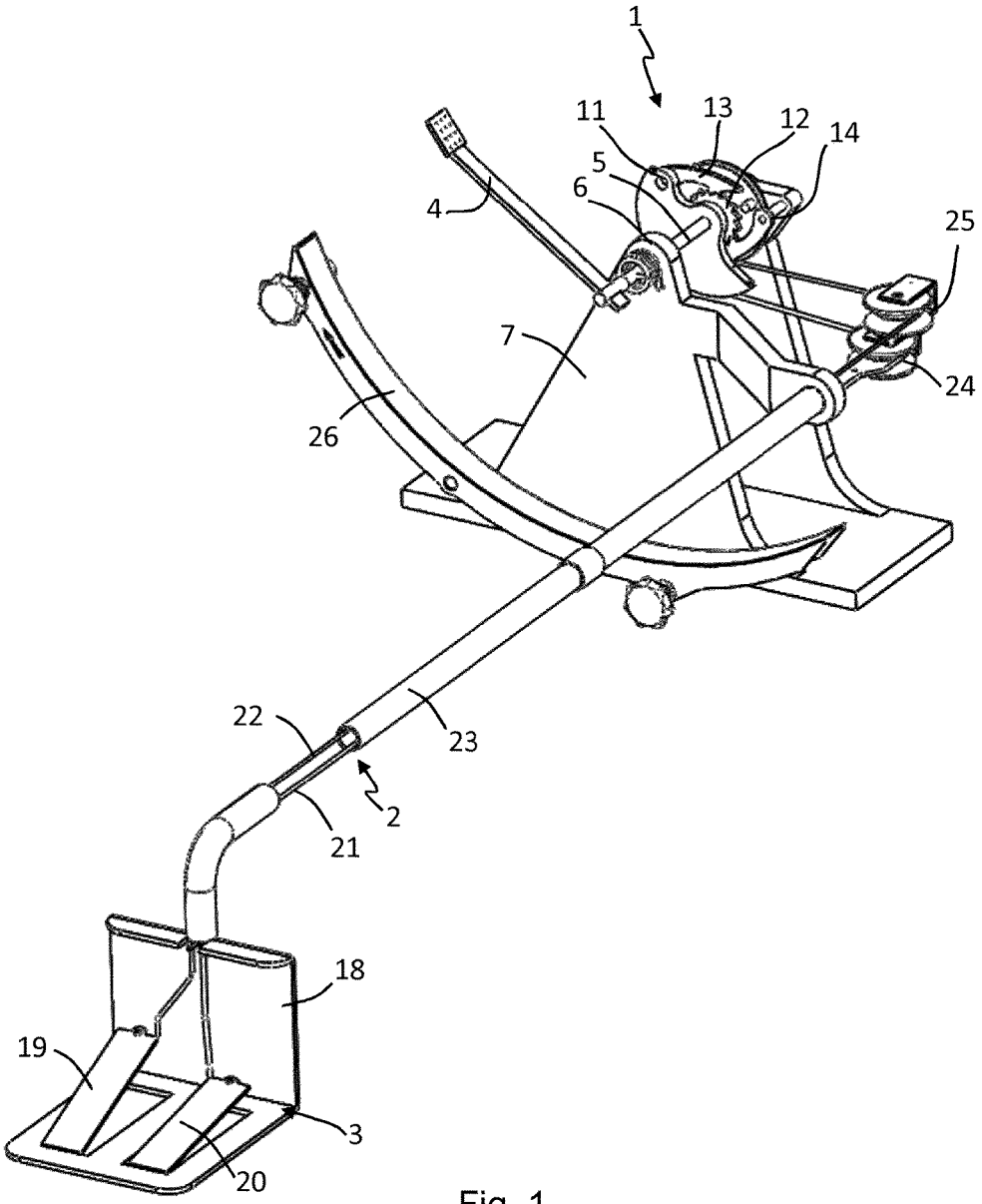
FIG. 1 shows a view of the machine as a whole, without blocking it and the supply ramp.
Figure 2:
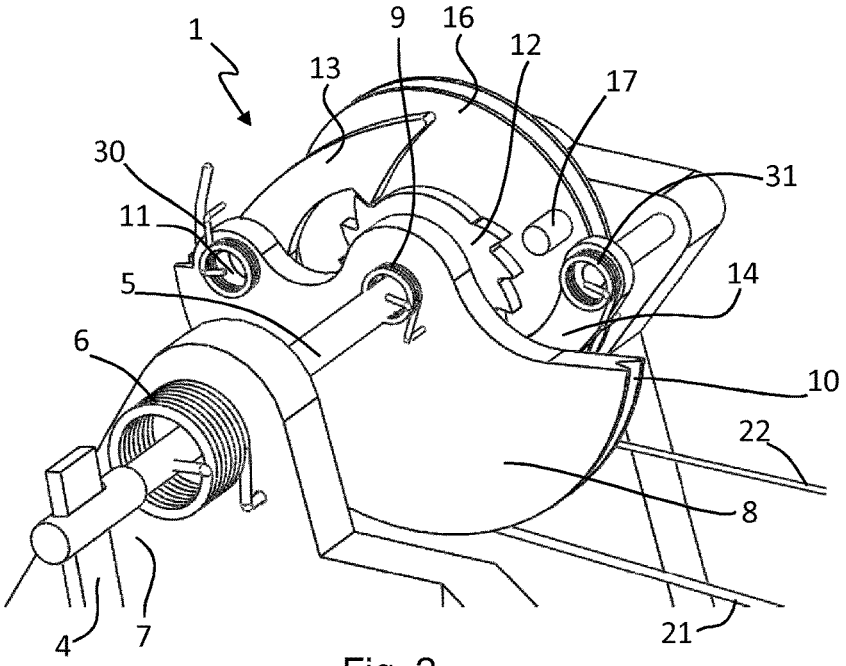
FIG. 2 shows the loading system with the arming pulley in tension.
Figure 3:
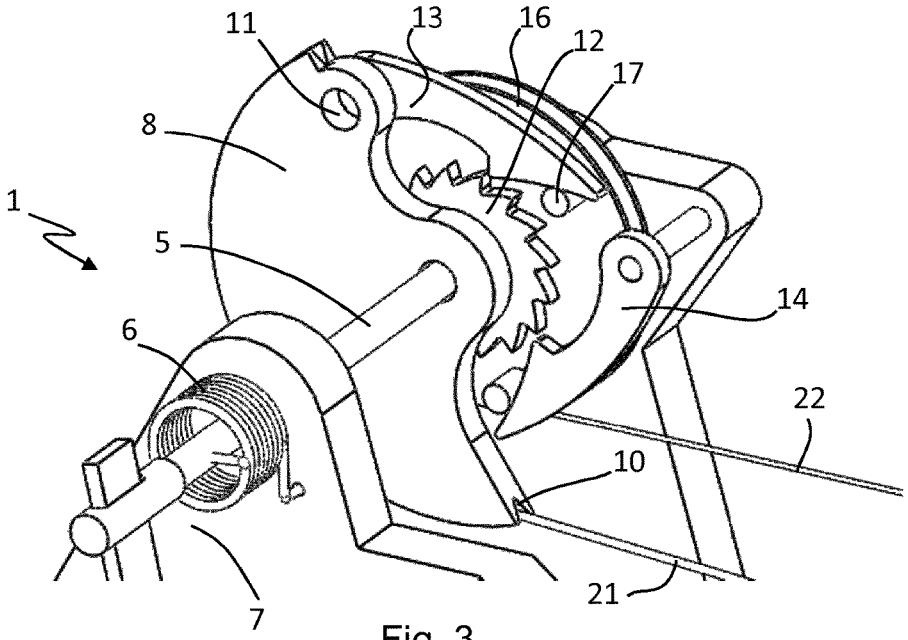
FIG. 3 shows details of a rear view of the loading system.
Figure 4:
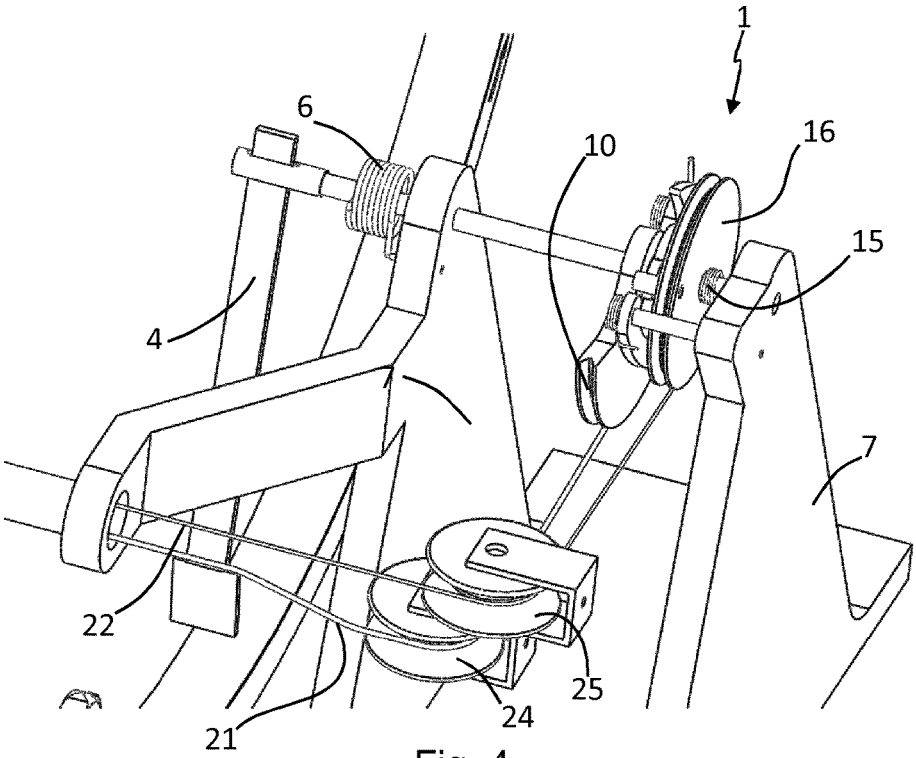
FIG. 4 is the loading system with the arming pulley at rest.
Figure 5:
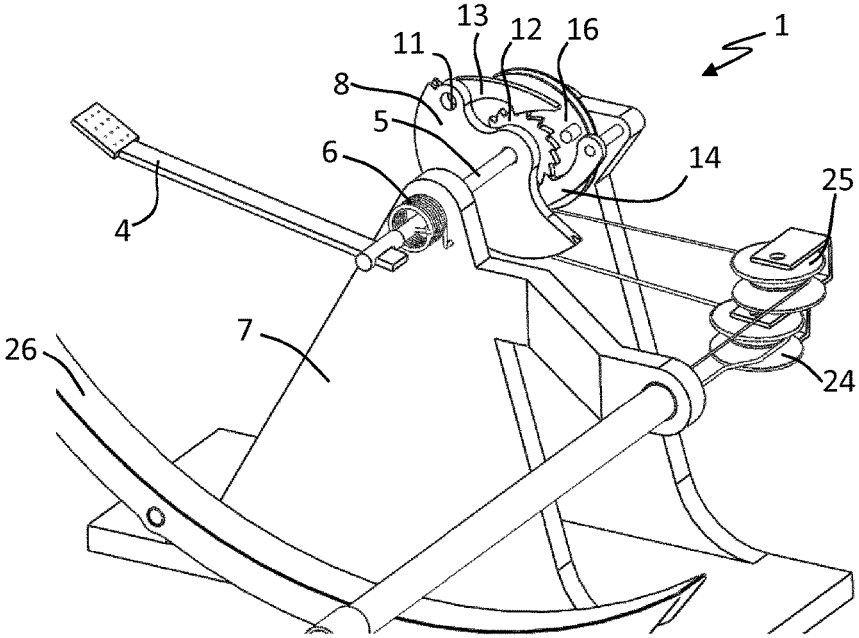
FIGS. 5 to 8 show the arming steps of the target-launching machine with the rotation of the projection element.
Figure 6:
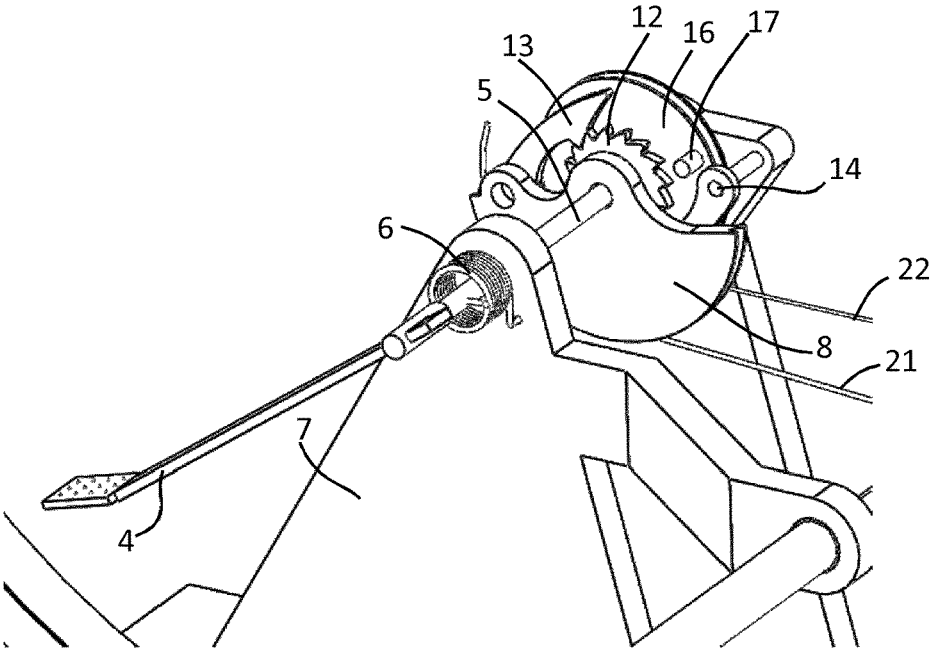
Figure 7:
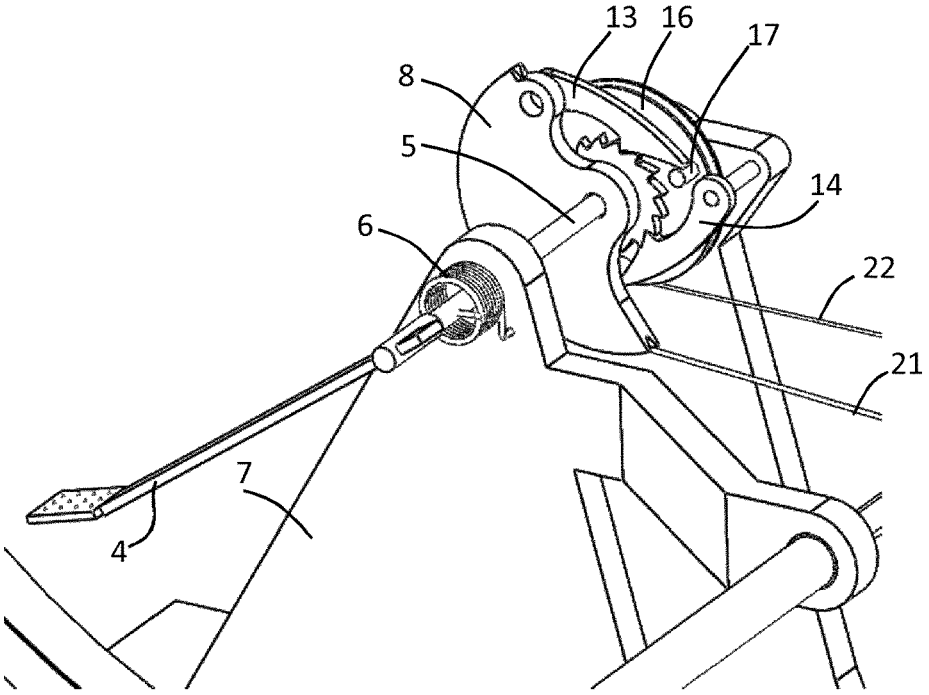
Figure 8:
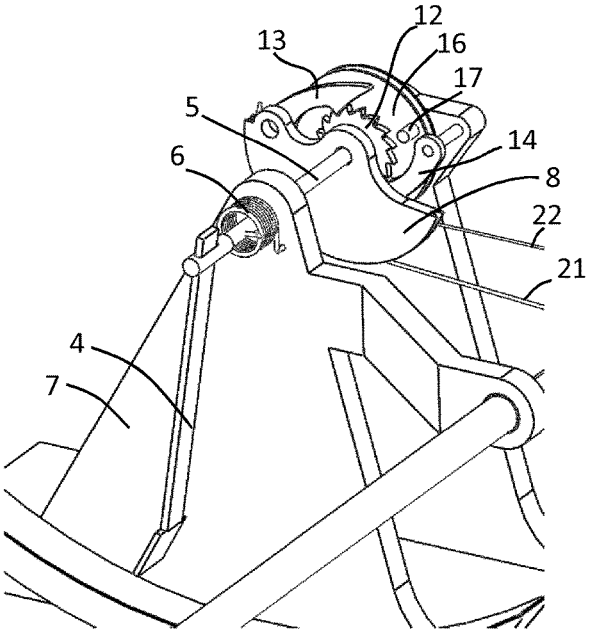
Figure 9:
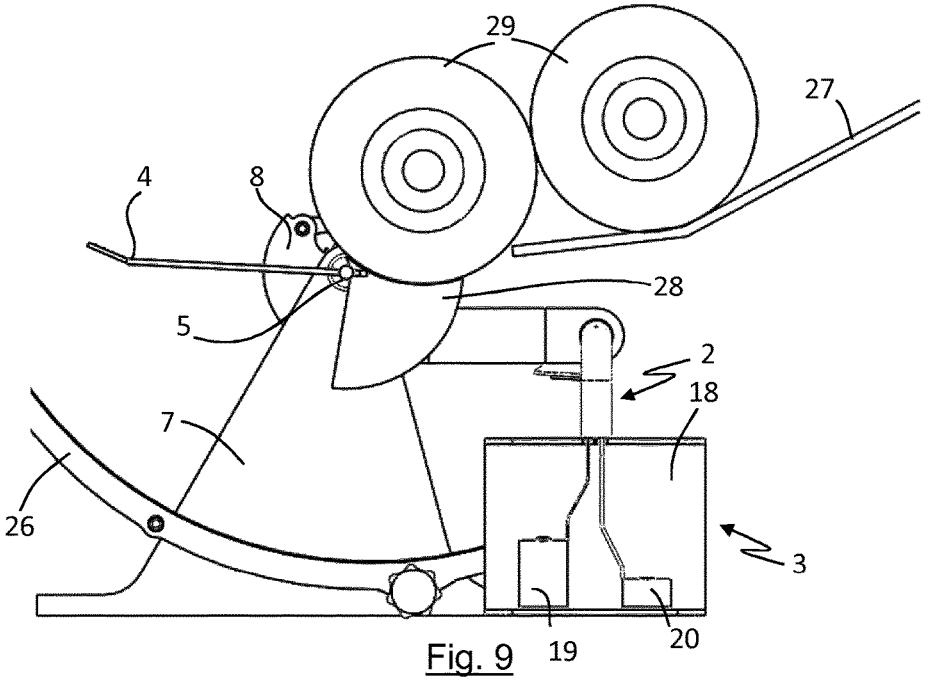
FIGS. 9 to 14 show the operation of the target-launching machine.
Figure 10:
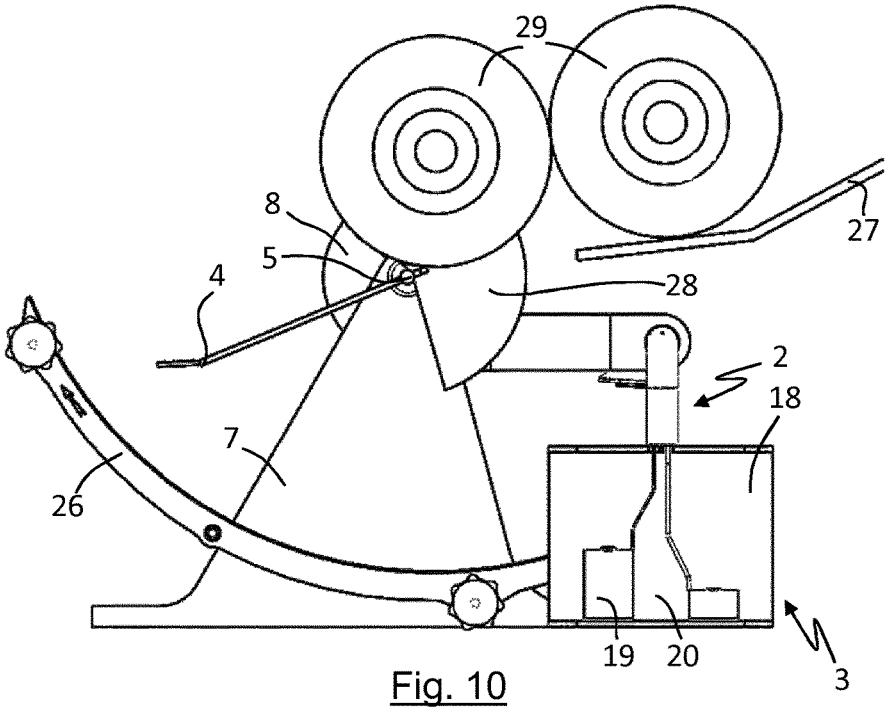
Figure 11:
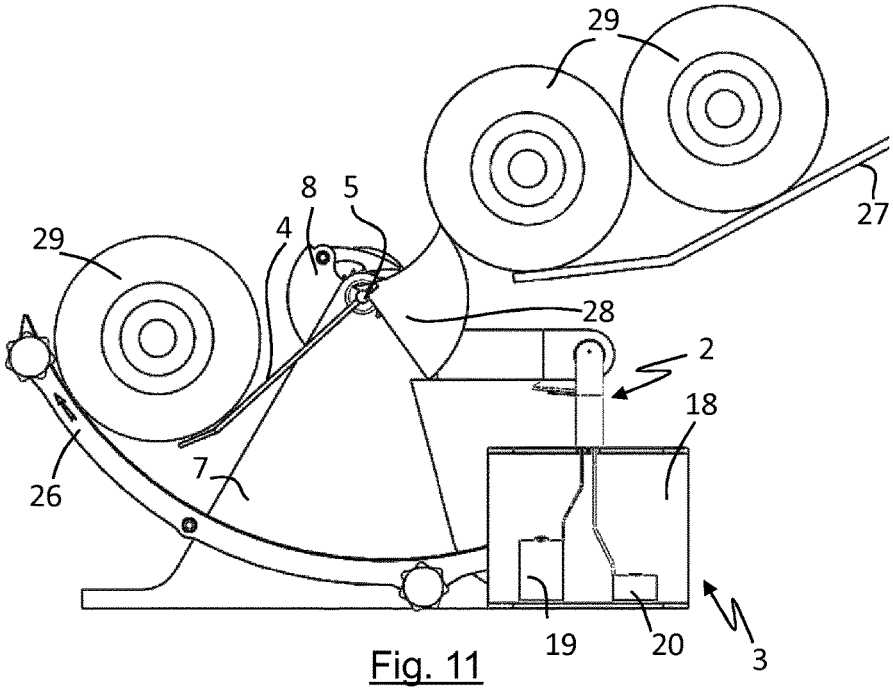
Figure 12:
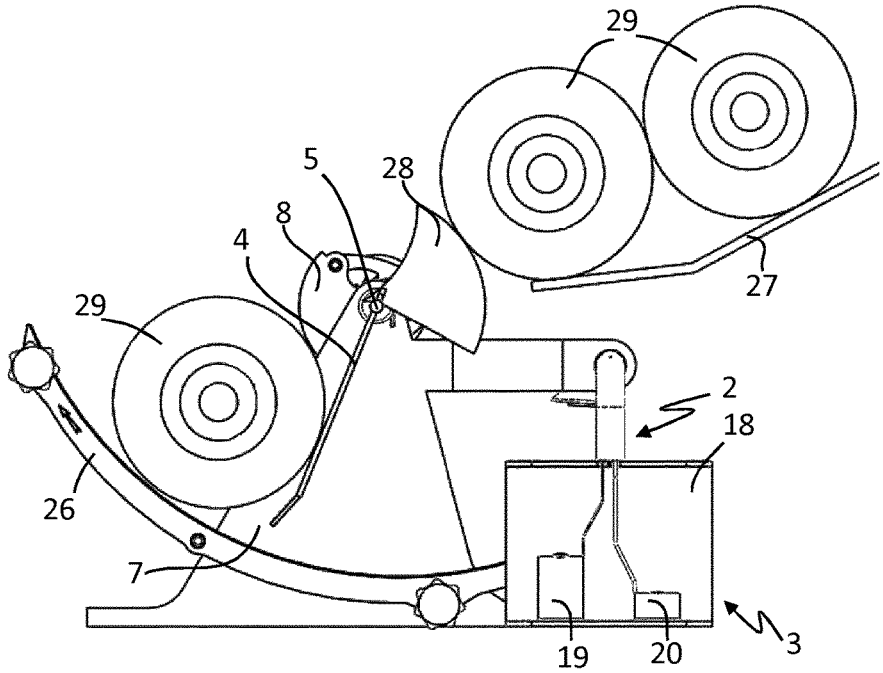
Figure 13:
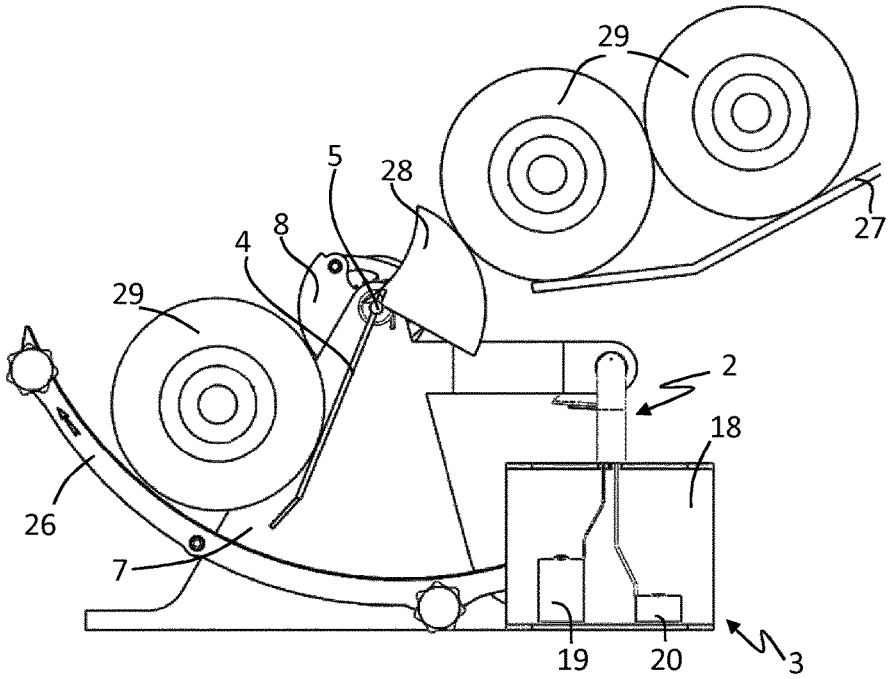
Figure 14:
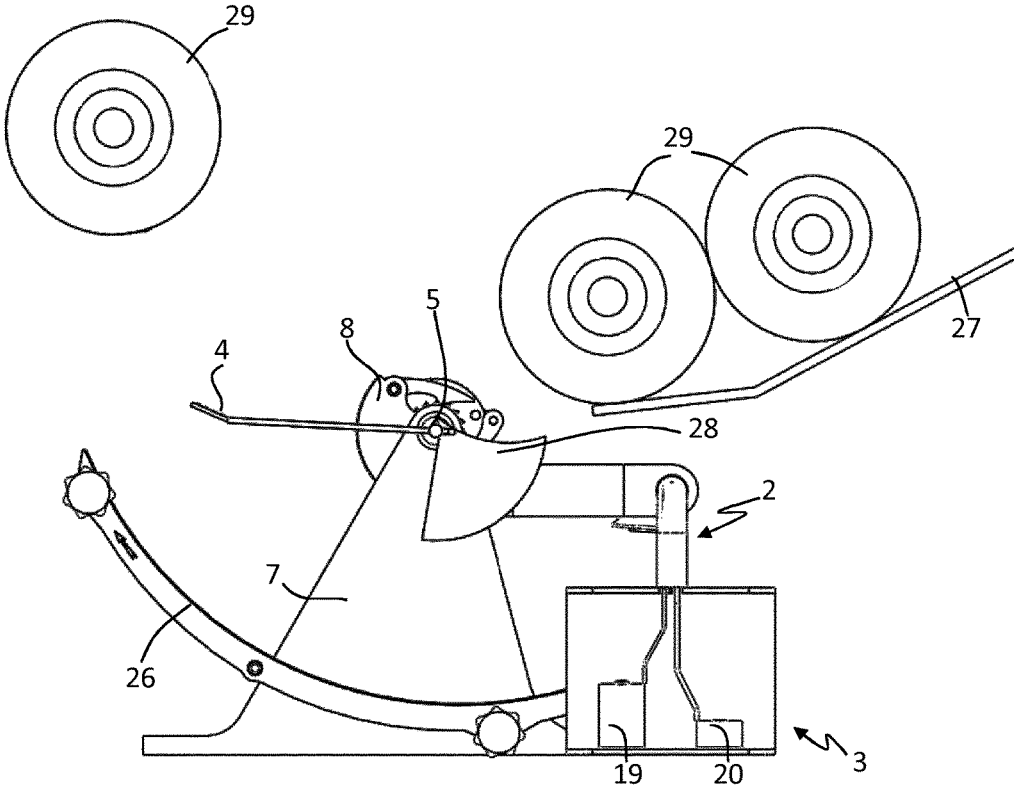

Before going into the detail of preferred embodiments of the invention in reference to the drawings in particular, other optional characteristics of the invention, that can be implemented in a combined manner according a combination or alternative manner, are indicated hereinafter:

the device for transmitting at least one flexible element between the actuator 3 and the power loading system comprises at least one arming guiding pulley 24 of the flexible element the arming guiding pulley 24 is mounted in rotation on a frame 7 supporting the loading system 1.

the actuator comprises a pedal configured to receive the force of the user.

the first portion is not supported by the frame.

the power transmission device 2 comprises a rigid connecting element fixed, at a first end, on a base 18 of the actuator 3 and, at a second end, to a frame 7 supporting the loading system 1.

the connecting element comprises a sleeve 23 defining an interior passage wherein the flexible element extends.

the sleeve 23 comprises a plurality of tubular sections that can be connected two-by-two.

the loading system 1 comprises an arming pulley 8 actuated in rotation by the power transmission device 2 in opposition to a spring for returning the arming pulley 9 to a rest position.

a portion of the flexible element engages a groove 10 of the arming pulley 8, with an end of the flexible element being fastened to the arming pulley 8.

the arming pulley 8 is configured to actuate in rotation in a first direction a gear wheel 12 by means of an arming claw 13.

the energy accumulator 6 comprises a torsion spring, with the gear wheel 12 being configured to drive, during its rotation in the first direction, a main axis 5 connected to an end of the torsion spring.

the loading system 1 comprises a retaining claw 14 that has a position of contact by default with the gear wheel 12 preventing a rotation of the gear wheel in a second direction opposite the first direction.

a triggering pulley 16 configured to raise the retaining claw 14 and the arming claw 13 in a release position of the gear wheel 12.

the gear wheel 12 comprises an angular sector devoid of teeth.

an arming cycle comprises at least the following steps:

compressing at least one pedal on the actuator 3, driving at least one arming cable 21 and one arming guiding pulley 24, rotating the arming pulley 8, simultaneous rotation of a gear wheel 12 driven via an arming claw 13 fixed to the arming pulley 8, simultaneous rotation of the gear wheel 12 and of a main axis 5, accumulation of energy in the energy accumulator 6 during the rotation of the main axis 5, advantageously, conservation of this energy by the retaining claw 14 which freezes the angular position of the gear wheel 12, recalling of the arming pulley 8 into an original position thanks to the return spring of the arming pulley 9.

Possibility of reiterating the action on the pedal in order to increase the potential energy.

The following triggering steps are carried out:

compressing at least one trigger pedal 19, driving at least one triggering cable 22 and one triggering guiding pulley 25, rotating the triggering pulley 16, separating the arming claw 13 and a retaining claw 14 by pressure of triggering abutments 17 fixed on the triggering pulley 16, releasing of the energy stored in the accumulator, returning of the triggering pulley 16 to an original position thanks to a return spring of the triggering pulley 15.

In order to facilitate the comprehension of the description and of the claims that will follow, the term arming cycle means: the activation of an actuator allowing for the accumulation or the storage of energy via a loading system. A plurality of arming cycles as such does not comprise a releasing between each cycle of the accumulated or stored energy.

An arming cycle corresponds to a movement of the user, followed by a releasing of this movement. During the first movement of the user, the actuator carries out a displacement in a first direction. During the releasing of the movement by the user, the actuator carries out a displacement in a direction inverse to the first direction. Advantageously, several cycles are provided, corresponding to a pumping effect on the pedal by the user. In this embodiment, the pressing on the pedal corresponds to the first movement of the user and to an accumulation of energy in the loading system. The actuator represented here by a pedal carries out a movement in a first direction. When the user releases the pedal, the latter returns into position without releasing the energy accumulated in the loading system.

The invention described hereinafter relates to a target-launching machine. Preferentially this machine comprises an arming device comprising a first portion preferably supported by a base 18, and not integral with the frame including an actuator 3, and a second portion preferably including a loading system 1 and an output element with both mounted preferably on a frame as well as at least one projection element 4, and a power transmission device 2.

With a goal of limiting the mass and the volume of the target-launching machine at least one from among the frame 7, the base 18, the actuator 3 is preferably but not in a limited manner made of aluminum. The projection element 4 can for example be made of composite, composite with organic material and with carbon fibers. The fibers can be oriented along a longitudinal direction of the projection element 4.

The projection element 4 preferably comprises at least one blade mounted in rotation, preferably about a longitudinal axis. Said projection element 4 having a first end fixed to the loading system 1, and a second end that has asperities or other elements that make it possible to increase the friction. The preferential constitution of the second end of said projection element 4 allows in particular the target 29 to carry out a rotation on itself in order to obtain a controlled trajectory. This second end represents for example a proportion of 10% of the total length of the projection element 4. In an embodiment of the invention. The useful portion of the projection element 4 which is outside of the portion of friction of the second end can be coated with a material with a low friction coefficient. This coating can for example be polytetrafluoroethylene or Teflon®. The projection element 4 also preferably comprises at least one blocker 28 positioned advantageously at the end of the fastening of the projection element 4. Said blocker 28 is advantageously configured to allow one target 29 to pass when the projection element 4 is in horizontal initial position, and to block the other targets 29 present in the launch ramp 27 as soon as arming has started and the projection element 4 is no longer horizontal.

The projection element 4 has for function the projection of targets 29, preferably one target 29 is launched after the other.

In addition the protective element 4 comprises on its second end at least one lug. This lug is advantageously located on the surface of the projection element in contact with the target 29. This lug has for purpose to create a gyroscopic effect on the target 29 during the actuating of the launch element. This gyroscopic effect allows for a clear improvement in the control of the trajectory of the target 29.

The actuator 3 comprises a base 18 and at least one device that allows the user to arm and/or to trigger the target-launching machine. Preferably the actuator 3 comprises an arming pedal 20 and a trigger pedal 19. The term pedal refers to a substantially flat element articulated around an axis of rotation of which the first end is raised in relation to a second end. The actuating of the pedal is carried out as such by exerting a force on the first portion which will then be lowered in order to arrive, preferably, at the level of the second portion. When the force is no longer applied on the first portion, the latter automatically returns to its initial position, Of course arming and triggering devices may not be similar or be formed of a monolithic part. As such, for example an arming lever that can be used with hands can be associated with a trigger pedal 19 that can be used with the feet.

The output element comprises in a preferred embodiment a main axis 5. Said main axis 5 is advantageously configured so that on the one hand it is positioned perpendicularly to the launch ramp 26. The term output element means any means able to move the projection element 4. On the other hand said main axis 5 longitudinally passes through the frame 7, by passing preferably through the arming pulley 8, the gear wheel 12 and the triggering pulley 16. In addition one of its ends is advantageously configured to allow for the fastening of the projection element 4. Preferentially, the main axis 5 is integrally fastened to the gear wheel 12. In this last embodiment, the main axis 5 carries out the same rotations as those carried out by the gear wheel 12.

The loading system 1 is advantageously supported by a frame 7, and comprises for example an energy accumulator 6, a launch ramp 26 and a store (not shown in the figures).

The energy accumulator 6 comprises at least one element that makes it possible to accumulate, preferably under mechanical force, the energy produced by a user and transmitted to the loading system connected to the accumulator.

Preferably the energy accumulator 6 comprises at least one spring preferably a torsion spring. Advantageously said torsion spring has a first end fixed to the frame 7 and a second end fixed to a main axis 5. In the preferred embodiment of the invention it is the rotation of the main axis 5 in a trigonometric direction that will allow for the compression of the torsion spring. During the release of the energy, the spring will return to its rest position while still allowing the main axis 5 to rotate in an anti-trigonometric direction and to abruptly drive the projection element 4 which is kinetically integral with this movement.

The launch ramp 26 is advantageously of concave curvilinear shape. Preferably the shape is concave upwards and in the arc of a circle. In addition, the launch ramp 26 advantageously has means for adjusting in order to allow for a variation in the length of the arc of circle. Said variation of arc of circle makes it possible to modify the trajectory of the targets 29 when the latter leave the launch ramp 26. Advantageously the launch ramp 26 comprises a width that is sufficient to receive at least one target 29 positioned vertically.

In a preferred embodiment of the invention the orientation of the two pedals are inverted. As such, preferably, the default inclination of the arming pedal 20 is configured so that it can be actuated by the heel of the user (not visible in the figures). The trigger pedal 19 is inclined in order to be activated with the tip of the foot of the user. This particular configuration makes it possible in particular to facilitate the arming of the machine by using the weight of the user. On the other hand, the triggering of the machine does not require any force from the user but greater sensitivity. As such being able to trigger the activation of the machine via the tip of the foot improves the effectiveness of the machine.

The store (not shown in the figures) can advantageously receive at least one target 29, but preferably several targets 29. The store also comprises a supply ramp 27 which allows for the link between the store and the projection element 4.

The frame 7 preferably comprises at least one arming pulley 8, a gear wheel 12, an arming claw 13, a retaining claw 14 and a triggering pulley 16.

Said arming pulley 8 in a preferred embodiment of the invention comprises a groove 10 that allows for the passage of a triggering cable 22. Advantageously the arming pulley 8 also comprises a pivot connection 11. Said pivot connection 11 is configured to in particular allow for the fastening of the arming claw 13. The retaining claw 14 is associated with the frame 7 by another pivot connection. In an embodiment of the invention, the pivot connection 11 also allows for the fastening of an end of the arming cable. Advantageously the arming pulley 8 rotates in a trigonometric direction for the arming of the target-launching machine. Said arming pulley 8 can return to its initial position in particular thanks to a return spring of the arming pulley 9.

The arming claw 13 advantageously comprises a first end allowing it to be fastened to the arming pulley 8, and a second end allowing for contact with the gear wheel 12. Advantageously a recalling element of the arming claw 30, preferably a torsion spring, makes it possible to maintain by default the arming claw 13 in contact with the gear wheel.

Said recalling element of the arming claw 30 also allows said arming claw 13 to be raised during the rotation in a first direction of the gear wheel 12.

In a preferred embodiment of the invention, the gear wheel 12 is configured to carry out a first rotation in a first direction, which is preferably a trigonometric direction. The gear wheel 12 can also carry out a second rotation in a second direction, which is preferably an anti-trigonometric direction. Advantageously the gear wheel 12 drives, during its rotations, a simultaneous rotation of the main axis 5.

Said gear wheel 12 advantageously comprises an angular sector devoid of teeth. Advantageously the size of said angular sector is strictly greater than the travel carried out by the gear wheel 12 during a rotation phase in the first direction about the main axis 5 corresponding for example to a press on the pedal or generally to a pumping movement applied to the actuator.

A first portion of the teeth of the gear wheel 12 is configured to allow the arming claw 13 to apply a traction force on the gear wheel 12 during the rotation of the arming pulley 8. Preferably said rotation of the arming pulley 8 and said traction force are carried out in a trigonometric direction. A second portion of the teeth of the gear wheel 12 is configured in order to allow for the unhindered circulation of the arming claw 13 when the arming pulley 8 is put back into place which is carried out preferably in an anti-trigonometric direction.

A retaining claw 14 is advantageously configured to not retain the gear wheel 12 during its rotation in its first direction of rotation which is preferably trigonometric. Said retaining claw 14 is in this embodiment able to be applied on the first portion of the teeth of the gear wheel 12 and as such prevent the gear wheel 12 from carrying out its second direction of rotation which is preferably anti-trigonometric. This configuration makes it possible to maintain the energy accumulated in the accumulator 6 during the release of the actuator by the user. As such, the accumulation of the energy in the accumulator 6 is carried out by a plurality of arming cycles.

In the preferred but not limited embodiment of the invention, an arming cycle comprises the activation of the actuator 3, the rotation of the arming pulley 8, the rotation of the gear wheel 12 in its first direction of rotation, the accumulation of energy in the energy accumulator 6 and the retaining of the arming pulley by the retaining claw 14.

Advantageously a recalling element of the retaining claw 31, preferably a torsion spring, makes it possible to maintain by default the retaining claw 14 in contact with the gear wheel. Said recalling element of the retaining claw 31 also allows said retaining claw 14 to be raised during the rotation in a first direction of the gear wheel 12.

As such, the gear wheel 12 and the arming 13 and retaining 14 claws operate as a ratchet system.

Finally, the triggering pulley 16 preferably comprises two triggering abutments 17. Said triggering abutments 17 are in particular configured to allow for the raising of the arming claw 13 and the raising of the retaining claw 14 in such a way that they no longer intercept with the teeth of the gear wheel 12. In a preferred embodiment of the invention the triggering abutments 17 simultaneously carry out the raising of the arming 13 and retaining 14 claws.

The transmission device advantageously comprises at least one flexible element, in the form, optionally, of at least one arming cable 21 and/or a triggering cable 22, optionally an arming guiding pulley 24 and/or a triggering guiding pulley 25 and a sleeve 23.

In a main embodiment of the invention, the at least one flexible element is materialized by an arming cable 21 and a triggering cable 22. In said embodiment, said arming cable 21 is fixed at one of its ends to the arming pulley 8 and at its other end to the arming pedal 20. In this same embodiment, the triggering cable 22 is fixed to at one of its ends to the triggering pulley 16 and at its other end to the trigger pedal 19.

In another embodiment of the invention, the flexible element can be a strap made of polymer for example. This element can also be made of a braided material in another embodiment. The term flexible element means any means that can modify its form, preferably in order to adapt to the desired angles between the actuator and the frame, while still allowing for a tension that is able to exert traction on the arming pulley 8 during the activation of the actuator 3. The flexible element advantageously has a rigidity according to its longitudinal direction, in order to transmit the traction efforts that are applied to it.

Preferentially, the flexible element is inserted into a preferably rigid sleeve 23 and with a length that may exceed two meters. The flexible element can also be located outside. Said preferably rigid sleeve 23 is comprised of at least one part. Preferably, the sleeve 23, is comprised of several parties comprising a vertical portion attached to the base 18, a horizontal portion and a bend linking the vertical and horizontal portions. The horizontal portion is comprised of at least one part, and preferably of several parts assembled in order to allow for an adjustment of the length of the sleeve 23 according to need. In addition a pulley may be positioned at the bend of the sleeve in order to maximize the output of the angle gearbox. The sleeve 23 can also be materialized by a rod or bar, in this case the flexible element is outside the rod.

Note that the activation of the flexible element is carried out in particular via traction. Therefore, risks concerning the stability of the system could be created. In order in particular to suppress these risks the sleeve 23 makes it possible to offset the effect of traction of the cables by being compressed. The sleeve 23 preferably forms an angle between 0° exclusive and 180° inclusive with the frame 7. Preferably the angle between the sleeve 23 and the frame 7 is 90°.

Advantageously the transmission device comprises at least one arming guiding pulley 24 and optionally a triggering guiding pulley 25, so as in particular to guarantee a straight traction force and without a loss of energy on the arming pulley 8, and this regardless of the angle formed by the sleeve 23.

Finally, a blocker 28 is advantageously positioned on the end of the fastening of the projection element 4. Said blocker 28 is mounted in rotation around an axis of rotation similar to the main axis 5. In addition, said blocker 28 comprises a section as a disk portion according to a direction perpendicular to its axis of rotation. Said disk portion optionally corresponds to a quarter of a circle. A first portion of the blocker 28 is preferably convex and forms an arc of circle able to push back the targets 29 that arrive via the supply ramp 27 without displacing said targets 29 on said supply ramp 27. A second portion of the blocker 28 is concave in an arc of circle. The angle of the arc of circle of said concave portion preferably corresponds to the angle of the convex arc of circle formed by the external portion of the targets 29.

In the preferred embodiment of the invention, the use of the target-launching machine begins with a first pressing of the foot on the arming pedal 20 that will, by the intermediary of the arming cable 21, pivot the arming pulley 8 in the trigonometric direction. The arming claw 13 maintained in contact with the gear wheel 12 by a recalling element of the arming claw 30, preferably a torsion spring, drives the latter.

As the main axis 5 as well as the projection element 4 change, the actuator 3, materialized in this embodiment by at least torsion springs that begin to be compressed.

When the arming pedal 20 is released, the retaining claw 14 freezes the position of the gear wheel 12 and maintains under pressure the torsion spring or springs; in addition, the return spring of the arming pulley 9 brings said arming pulley 8 back to its original position.

The operations described hereinabove represent a possible and preferred embodiment of an arming cycle. The storage of energy is carried out thanks to a plurality of arming cycles. Another advantage of the reiteration of this arming cycle makes it possible in addition to modify the quantity of accumulated energy according to the desired projection distance or the number of targets projected. The carrying out of several cycles will have the effect of increasing the accumulated energy in the accumulator 6. This is in particular materialized in this embodiment by the deformation of the torsion spring or springs.

In addition, this reiteration of the movement of the user, which is preferably but non limiting a pumping movement on the arming pedal 20, makes it possible to reduce the physical force required to use the machine. Indeed, the complete arming of the machine by a user without reiteration of the movement requires a substantial force. By carrying out a plurality of movements each requiring less energy, the use of the machine is open to users that have less physical force (children for example). The use of it is then simplified.

In addition, the decrease in the force required for the storing of the energy makes it possible to have a machine that does not need an anchoring in the ground to operate and which has a less substantial total mass. Due to the separation between the actuator 3 and the frame 7 a contraction force is exerted on the sleeve 23 which links the base 18 and the frame 7. The resistance of the sleeve 23 must therefore be sufficient which accentuates the weight and the volume of the target-launching machine. By reducing the torque required for the actuating of the actuator 3, the force of the sleeve is all the more so reduced. As such, the lightening of the mass and of the volume of the machine is directly linked to the capacity of the machine to operate thanks to a reiteration of a movement of the user in order to arm a launcher.

Another interest in reducing the mass and the volume of the machine resides in the use of the latter. Indeed, the machine must be within the scope of all, from a financial standpoint as well as in terms of physical capacity, since it is entirely manual. The use of this machine must be within the scope of adolescents as well as the elderly, as such, the torsion springs that will oppose the displacement of the pedal must be the least stiff as possible.

In order to limit the torque, an angular sector of the gear wheel 12 is devoid of teeth in order to prevent the arming claw 13 from driving the gear wheel 12 further forward. Therefore, any subsequent press on the arming pedal 20 will have no effect, which will preserve the mechanism.

At the other end of the projection element 4, there is a supply ramp 27 able to receive a target 29. This shape is found in the extension of the storage container containing one or several targets 29.

During the charging phase of the accumulator, the projection element 4 will carry out a rotation preferably between 90 and 135 degrees in the trigonometric direction. The inclination will provoke the displacement of the target 29 to the launch ramp 26 while still maintaining the contact with the projection element 4.

The blocker 28 located beyond the supply ramp 27 then opposes the displacement under the effect of the gravity of the target 29.

Then a pressing on the trigger pedal 19, via the triggering cable 22, will cause the rotation in the trigonometric direction of the triggering pulley 16. The triggering abutments 17 will simultaneously separate the two retaining and arming claws until the gear wheel 12 is released.

The torsion spring or springs of the accumulator will provoke via their decompression an abrupt rotation of the main axis 5 as well as of the projection element 4. The target 29 will then slide along the launch ramp 26 and come into contact with the end of the projection element 4 comprising the asperities. The latter will generate or accentuate a rotation of the target 29 on itself in order to obtain a uniform trajectory.

The launch cycle ends with the projection element 4 in horizontal position receiving another target 29.

The releasing the trigger pedal 19 allows the return spring of the triggering pulley 15 to return the triggering pulley 16 to its original position and as such release the arming and retaining claws so that they again come into contact with the gear wheel 12.

The invention is not limited to the embodiments described hereinabove but extends to all embodiments in conformity with its principles.

REFERENCES

1. Loading system
2. Power transmission device
3. Actuator
4. Projection element
5. Main axis
6. Energy accumulator
7. Frame
8. Arming pulley
9. Return spring of the arming pulley
10. Groove
11. Pivot connection
12. Gear wheel
13. Arming claw
14. Retaining claw
15. Return spring of the triggering pulley
16. Triggering pulley
17. Triggering abutments
18. Base
19. Triggering pedal
20. Arming pedal
21. Arming cable
22. Triggering cable
23. Sleeve
24. Arming guiding pulley
25. Triggering guiding pulley
26. Launch ramp
27. Supply ramp
28. Blocker
29. Target
30. Recalling element of the arming claw
31. Recalling element of the retaining claw

The invention claimed is:

1. A target-launching machine comprising:

a projection element for projecting a target mounted mobile on a frame, an arming device of the projection element, said arming device comprising:

a first portion including an actuator, with the actuator configured to receive an input energy from a user, a loading system of an energy accumulator configured to store the input energy in the energy accumulator, a second portion including an output member mounted on the frame, with the output member being configured to drive the projection element, said projection element being mobile via the output member through a release of a quantity of energy accumulated in the energy accumulator, a connection between the first portion and the second portion by a power transmission device, wherein the power transmission device comprises at least one flexible element between the actuator and the loading system, and wherein the power transmission device further comprises a rigid connecting element fixed, at a first end thereof, on a base of the actuator and, at a second end thereof, to the frame, wherein the rigid connecting element comprises a sleeve defining an interior passage wherein the flexible element extends, wherein the sleeve comprises a plurality of tubular sections connected two-by-two in a removable manner, wherein the actuator is mobile according to an arming cycle comprising a movement of the actuator from a rest position generated by a force from the user that procures input energy and a movement of the actuator to the rest position during a releasing of a force from the user and in that the loading system is configured to store in the energy accumulator produced by an energy of a plurality of arming cycles, wherein the second portion comprises the loading system and the energy accumulator, said actuator and said loading system being connected by the power transmission device, wherein the loading system comprises an arming pulley actuated in rotation by the power transmission device in opposition to a return spring of an arming pulley in a rest position, and wherein the arming pulley is configured to actuate in rotation in a first direction a gear wheel by an arming claw.

2. The target-launching machine as claimed in claim 1, wherein the first portion is not supported by the frame.

3. The target-launching machine as claimed claim 1, wherein the power transmission device comprises at least one arming guiding pulley of the flexible element.

4. The target-launching machine as claimed claim 3, wherein the arming guiding pulley is mounted in rotation on the frame.

5. The target-launching machine as claimed claim 1, wherein a portion of the flexible element engages a groove of the arming pulley, with an end of the flexible element being fastened to the arming pulley.

6. The target-launching machine according to claim 5, wherein the energy accumulator comprises a torsion spring, with a gear wheel being configured to drive, during its rotation in a first direction, a main axis connected to an end of the torsion spring.

7. The target-launching machine according to claim 1, wherein the loading system comprises a retaining claw that has a default position of contact with the gear wheel that prevents a rotation of the gear wheel in a second direction opposite the first direction.

8. The target-launching machine according to claim 7, comprising a triggering pulley configured to raise the retaining claw and the arming claw in a release position of the gear wheel.

9. The target-launching machine according claim 1, wherein the gear wheel comprises an angular sector devoid of teeth.

10. The target-launching machine according to claim 1, wherein the actuator comprises a pedal configured to receive the force of the user.

11. A method for using a target-launching machine according claim 1, with the method comprising the following arming steps:

a. activation of an actuator by the input energy coming from a user; and b. transmission of the input energy to a loading system into the energy accumulator;

wherein an energy required to proceed with launching at least one target is accumulated by a plurality of arming cycles, with each arming cycle comprising a movement of the actuator from a rest position generated by an effort of the user procuring the input energy and a movement of the actuator to the rest position during a releasing of the effort from the user, wherein an arming cycle comprises at least the following steps:

a. compressing at least one pedal on the actuator, b. driving at least one arming cable and one arming guiding pulley, c. rotating an arming pulley, d. simultaneous rotation of a gear wheel driven via an arming claw fixed to the arming pulley, e. simultaneous rotation of the gear wheel and of a main axis, f. accumulating energy in the energy accumulator during the rotation of the main axis, g. returning the arming pulley into an original position thanks to a return spring of the arming pulley, and h. conserving energy by the action of a retaining claw by immobilizing in rotation the gear wheel.

12. A method for using a target-launching machine according claim 1, with the method comprising the following arming steps:

a. activation of an actuator by the input energy coming from a user; and b. transmission of the input energy to a loading system into the energy accumulator;

wherein an energy required to proceed with launching at least one target is accumulated by a plurality of arming cycles, with each arming cycle comprising a movement of the actuator from a rest position generated by an effort of the user procuring the input energy and a movement of the actuator to the rest position during a releasing of the effort from the user, the method comprising the following triggering steps:

a. compressing at least one trigger pedal, b. driving at least one triggering cable and a triggering guiding pulley, c. rotating a triggering pulley, d. separating an arming claw and a retaining claw by pressure of triggering abutments fixed on the triggering pulley, e. releasing of energy stored in the energy accumulator, and f. returning the triggering pulley into an original position thanks to a return spring of the triggering pulley.

* * * * *